US007665516B2

(12) United States Patent
Roberts et al.

(10) Patent No.: US 7,665,516 B2
(45) Date of Patent: Feb. 23, 2010

(54) PERMANENT ANCHORING DEVICE

(75) Inventors: William M. Roberts, Tomball, TX (US); Lap T. Tran, Houston, TX (US)

(73) Assignee: Smith International, Inc., Houston, TX (US)

( * ) Notice: Subject to any disclaimer, the term of this patent is extended or adjusted under 35 U.S.C. 154(b) by 245 days.

(21) Appl. No.: 11/742,314

(22) Filed: Apr. 30, 2007

(65) Prior Publication Data

US 2008/0264627 A1 Oct. 30, 2008

(51) Int. Cl.
*E21B 23/01* (2006.01)
*E21B 23/06* (2006.01)

(52) U.S. Cl. ..... 166/118; 166/387

(58) Field of Classification Search ..... 166/120, 166/121, 118, 387

See application file for complete search history.

(56) References Cited

U.S. PATENT DOCUMENTS 3,526,277 A 9/1970 Scott
4,526,229 A 7/1985 Dickerson
4,753,444 A 6/1988 Jackson et al.
4,852,649 A 8/1989 Young
5,046,557 A 9/1991 Manderscheid
6,164,377 A 12/2000 Roberts
2005/0189103 A1 * 9/2005 Roberts et al. ..... 166/134

OTHER PUBLICATIONS

Canadian Office Action for related Application No. 2,629,591 dated Oct. 9, 2009 (2 pages).

* cited by examiner

*Primary Examiner*—David J Bagnell
*Assistant Examiner*—Brad Harcourt
(74) *Attorney, Agent, or Firm*—Osha • Liang LLP

(57) ABSTRACT

An anchoring device to secure a packer assembly within a casing, including a frangible ring having a plurality of grips on an outer circumference, wherein a first end of the frangible ring includes a plurality of circumferentially spaced slots, and an expansion ring having a plurality of castellations configured to engage the slots of the first end of the frangible ring is disclosed. A method to secure a packer assembly in a casing, including engaging a plurality of arcuate segments of a segmented ring with a plurality of slots in a first end of a frangible ring, engaging a plurality of castellations of an expansion ring with the plurality of slots on a second end of the frangible ring, and moving the expansion ring in an axial direction towards the frangible ring and splitting the frangible ring into a plurality of slip segments, thereby radially extending the plurality of slip segments and segmented ring into the casing is also disclosed.

18 Claims, 13 Drawing Sheets

PERMANENT ANCHORING DEVICE

BACKGROUND OF DISCLOSURE

1. Field of the Disclosure

The disclosure relates generally to methods and apparatus for drilling and completing well bores. More specifically, the disclosure relates to methods and apparatus for a permanent anchoring device in a packer assembly.

2. Background Art

In the drilling, completing, or reworking of oil wells, a great variety of downhole tools are used. Particularly, downhole tools, referred to as packers and bridge plugs, are designed to isolate certain areas in a wellbore, and are well known in the art of producing oil and gas. Packers and bridge plugs are similar in structure and similar in the method in which they are set in a casing, however, they are designed to perform different functions in a wellbore. A bridge plug may be set in a casing as a lower limit, whereas a packer may be set above the bridge plug as an upper limit forming an isolated zone between the two. It is then possible to pressure down through a bore of the packer to communicate with the isolated region.

Downhole packers are typically used to seal an annular area formed between two coaxially disposed tubulars within a wellbore. A packer may seal, for example, an annulus formed between production tubing disposed within wellbore casing. Alternatively, some packers seal an annulus between the outside of a tubular and an unlined borehole. Routine uses of packers include the protection of casing from pressure, both well and stimulation pressures, and protection of the wellbore casing from corrosive fluids. Other common uses may include the isolation of formations or of leaks within wellbore casing, squeezed perforation, or multiple producing zones of a well, thereby preventing migration of fluid or pressure between zones. Packers may also be used to hold kill fluids or treating fluids in the casing annulus.

A downhole packer assembly may be run into a wellbore with a smaller initial outside diameter that then expands externally to seal the wellbore. The two most common forms are the production or test packer and the inflatable packer. Packers employ flexible, elastomeric elements that expand. The expansion of the former may be accomplished by squeezing the elastomeric elements (somewhat doughnut shaped) between two plates, forcing the sides to bulge outward. The expansion of the latter is accomplished by pumping a fluid into a bladder, in much the same fashion as a balloon, but having more robust construction. Packers may be set in cased holes while inflatable packers may be used in open or cased holes. Installing the packer downhole involves running it on a wireline, pipe or coiled tubing. While, some packers may be designed to be removable, others are installed as permanent, and therefore not retrievable. Permanent packers must be drilled out and destroyed to be removed from a wellbore. The pieces of the packer are circulated back to the surface in the drilling fluid. As such, permanent packers are constructed of materials that are easy to drill or mill out.

Traditional packers include a sealing element having anti-extrusion rings on both upper and lower ends and a series of slips above and/or below the sealing element. Typically, a setting tool would be run with the packer to set the packer. The setting may be accomplished hydraulically due to relative movement created by the setting tool when subjected to applied pressure. This relative movement causes the slips to move up cones and extend into the surrounding tubular casing wall. At the same time, the sealing element may be compressed into sealing contact with the surrounding tubular casing wall. The set position of the packer may be held in place by a body lock ring, which may prevent reversal of the relative movement.

The terms "packer" and "bridge plug" may be used interchangeably when describing the structure and manner in which they are set in a casing. A significant difference in the functionality of the two is the ability to pressure down through a bore of a packer. For figures and descriptions within, references are made to packers only. FIG. 1 further illustrates the components of a typical packer assembly 100 as installed in a wellbore 104. A packer assembly 100 may be set in a well casing 102 lining a wellbore 104 drilled into an oil and gas producing formation 106. Packer 100 may be connected with a production tubing string 108 leading to a well head, not shown, at the surface end of the well for conducting produced fluids from the well bore 104 to the well head. Casing 102 may be perforated at 110 to allow well fluids, such as oil and gas, to flow from the formation through the casing into the wellbore. Packer 100 may be locked with the wall of casing 102 by upper slips 112 and lower slips 114. Packer 100 may include a seal 116 which is expanded against the wall of casing 102 by longitudinal compressive forces forming a fluid-tight seal around packer 100. Seal 116 ensures that the formation pressure is held in wellbore 104 below seal assembly 116 and formation fluids are forced through the bore of packer 100 to flow to the surface through production tubing 108.

In the past, various configurations of packer assemblies have been disclosed for use in downhole operations. U.S. Pat. No. 4,753,444 to Jackson et al. discloses a packer having a conventional sealing element located around the outside of a mandrel. Anti-extrusion rings and back-up rings contain the seal element ends and are compressed to radially expand the seal element outwardly into contact with the well casing. U.S. Pat. No. 4,852,649 to Young discloses packers having multiple moving packer elements which distribute stresses across the elements as the packer elements expand to seal the wellbore annulus. In U.S. Pat. No. 5,046,557 to Manderscheid, multiple seal elements are separated with spacers around the exterior surface of a mandrel. The seal elements are hydraulically set to contact the well casing.

Further, U.S. Pat. No. 3,526,277 to Scott discloses an anchoring means for well bore tools. Disclosed is an expander having oppositely facing conical surfaces which cooperate with a pair of spaced apart sets of slip elements that are independently outwardly movable into anchoring engagement with the well wall.

Still further, U.S. Pat. No. 4,526,229 to Dickerson discloses a hydraulic packer assembly for sealing an annulus between a well casing and a tubing string inserted within the well casing having a packer and a setting tool. The packer includes a packer body having an internal bore with a seal and gripping members mounted on its exterior surface for engaging the interior surface of the well casing.

An integral component to the functioning of a downhole packer assembly is the anchoring device which radially expands to engage the casing wall to prevent movement in the wellbore. U.S. Pat. No. 6,164,377, which is assigned to the assignee of the present disclosure, discloses a slip assembly for engaging a downhole tool and preventing it from rotating within a casing. The slip assembly comprises a frangible ring and a plurality of slip pads supported on the ring, the slip pads preferably engaging the downhole tool by a tongue and groove mechanism. In addition, the camming interfaces between each slip pad and the tool comprise planar surfaces.

In setting the packer assembly in the well casing, an axial force is imparted on a mechanism in the anchoring device to cause a frangible ring to break into a number of individual slip segments. The slip segments are forced out radially to engage the casing wall inner diameter. In the separation of the frangible ring into individual slip segments, and during the subsequent radial expansion, a random and uneven spacing of the slip segments often occurs around the circumference of the casing wall. The uneven spacing between slip segments creates a localized stress pattern that is closely associated with the random contact with the casing wall.

Additionally, the slip segments disclosed in prior art have a smaller radius of curvature than the casing in which they are set. This geometry causes a contact area between the slip segment and the casing wall to be concentrated at the center plane of each slip segment. The small contact radii of the slip segments creates a scallop effect that must distort the casing or break the slip in additional locations to gain contact area. This configuration may essentially "gouge" into the casing wall or break off corners of the slips in an effort to engage the casing wall. The metal deformation caused by the gouging may further create higher stress areas which may be detrimental to the integrity of the engagement between the packer assembly and the casing wall.

Accordingly, there exists a need for an anchoring device that forces the slips into the casing wall to distribute the load more uniformly when set in the casing, thereby mitigating excessive gouging of the casing or breaking off of teeth.

SUMMARY OF INVENTION

In one aspect, embodiments disclosed herein relate to an anchoring device to secure a packer assembly within a casing, including a frangible ring having a plurality of grips on an outer circumference, wherein a first end of the frangible ring includes a plurality of circumferentially spaced slots, and an expansion ring having a plurality of castellations configured to engage the slots of the first end of the frangible ring.

In another aspect, embodiments disclosed herein relate to an anchoring device to secure a packer assembly within a casing, including a frangible ring having a plurality of grips on an outer circumference, wherein a first end and a second end of the frangible ring include a plurality of circumferentially spaced slots, an expansion ring having a plurality of castellations configured to engage the slots of the first end of the frangible ring, and a segmented ring including a plurality of segments configured to engage the slots of the second end of the frangible ring, wherein a curved outer surface of each of the individual arcuate segments of the segmented ring has a radius of curvature that is larger than the radius of curvature of an inner diameter of the casing.

In another aspect, embodiments disclosed herein relate to a method to secure a packer assembly in a casing, including engaging a plurality of arcuate segments of a segmented ring with a plurality of slots in a first end of a frangible ring, engaging a plurality of castellations of an expansion ring with the plurality of slots on a second end of the frangible ring, and moving the expansion ring in an axial direction towards the frangible ring and splitting the frangible ring into a plurality of slip segments, thereby radially extending the plurality of slip segments and segmented ring into the casing.

DETAILED DESCRIPTION

Figure 1:
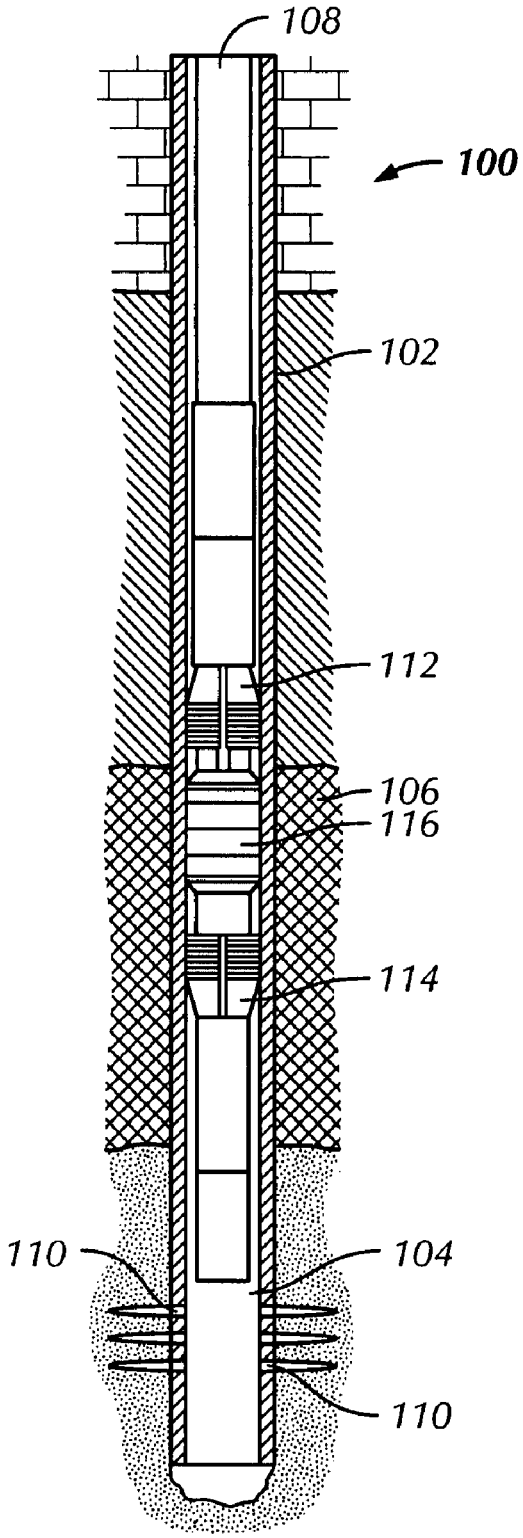
FIG. 1 (Prior Art)
FIG. 1 shows a section view of a prior art packer assembly as set in a wellbore.
Figure 2:
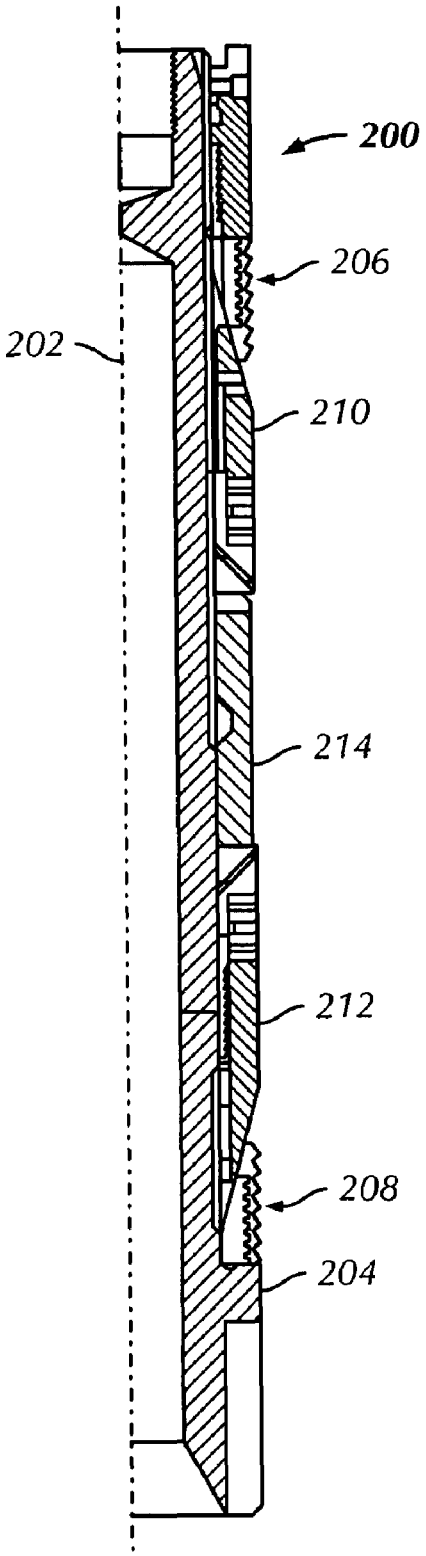
FIG. 2 (Prior Art)
FIG. 2 shows a partial section view of a prior art packer assembly in an unexpanded condition.
Figure 3:
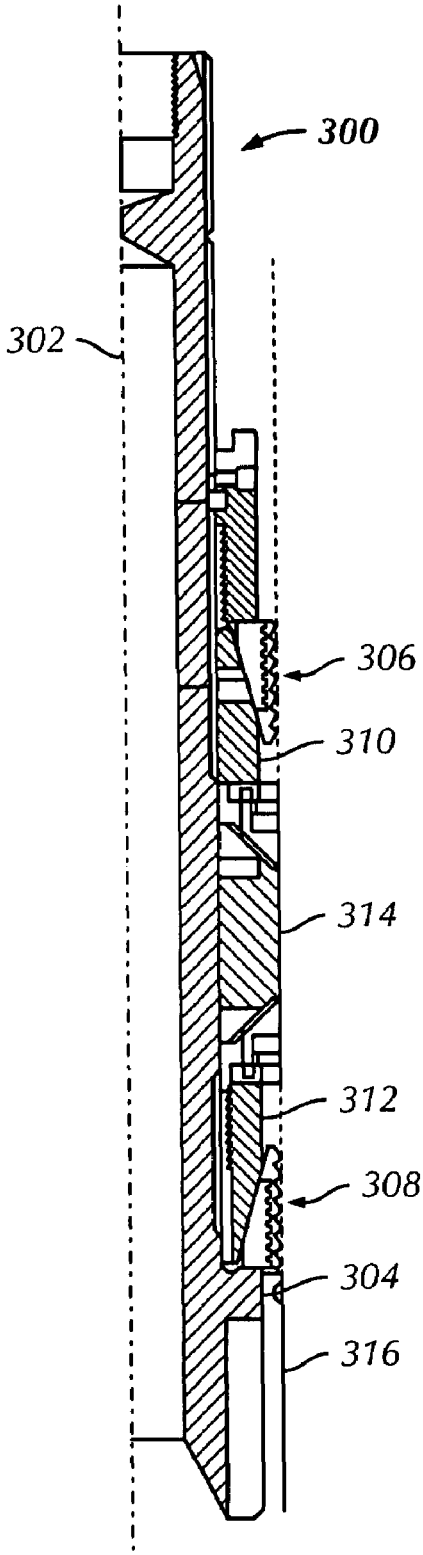
FIG. 3 (Prior Art)
FIG. 3 shows a section view of a prior art packer assembly in an expanded condition.

Downhole packer assemblies are run into a wellbore and set to provide a seal in an annulus between the packer assembly and the casing of the wellbore. FIGS. 2 and 3 are shown to provide a general description of the engagement between a packer assembly and the wellbore. As mentioned previously, while packers and bridge plugs may be similar in structure, terms and figures used herein reference a packer only.

Referring to FIG. 2, a partial section view of a packer assembly 200 is shown in an unexpanded condition, or after having been run downhole but prior to setting it in a wellbore. The unexpanded condition is defined as the state in which packer assembly 200 is run downhole and before a force is applied to radially expand and engage the casing wall and set packer assembly 200 in the wellbore. Packer assembly 200 includes a central mandrel 204 having a center axis 202 about which other components are mounted. An upper anchoring device 206 and a lower anchoring device 208 are provided adjacent an upper cone 210 and a lower cone 212, respectively. A sealing element 214 seals an annulus between the packer assembly and the casing wall. The sealing element 214 may be formed of any material known in the art, for example, elastomer or rubber.

Referring now to FIG. 3, a partial section view of a downhole packer assembly 300 is shown in an expanded condition, or after having been set in a wellbore. The expanded condition is defined as the state at which a force has been applied to radially expand and engage the casing wall and set packer assembly 300 in the wellbore. Packer assembly 300 includes a central mandrel 304 having a center axis 302 about which other components are mounted. An axial force is applied to force upper and lower anchor assemblies 306, 308 to travel up an inclined surface of upper and lower cone 310, 312, respectively. In traveling on upper and lower cone 310, 312, anchor assemblies 306, 308 travel in both an axial and radial direction to engage casing wall 316. Upper anchoring device 306 and lower anchoring device 308 are shown engaged with casing wall 316. A sealing element 314 is shown compressed and expanded to create a seal between packer assembly 300 and casing wall 316.

In one aspect, embodiments of the present disclosure relate to a downhole tool for sealing tubing or other pipe in a casing of a well. In particular, embodiments disclose an anchoring device for use in a packer assembly.

Figure 4:
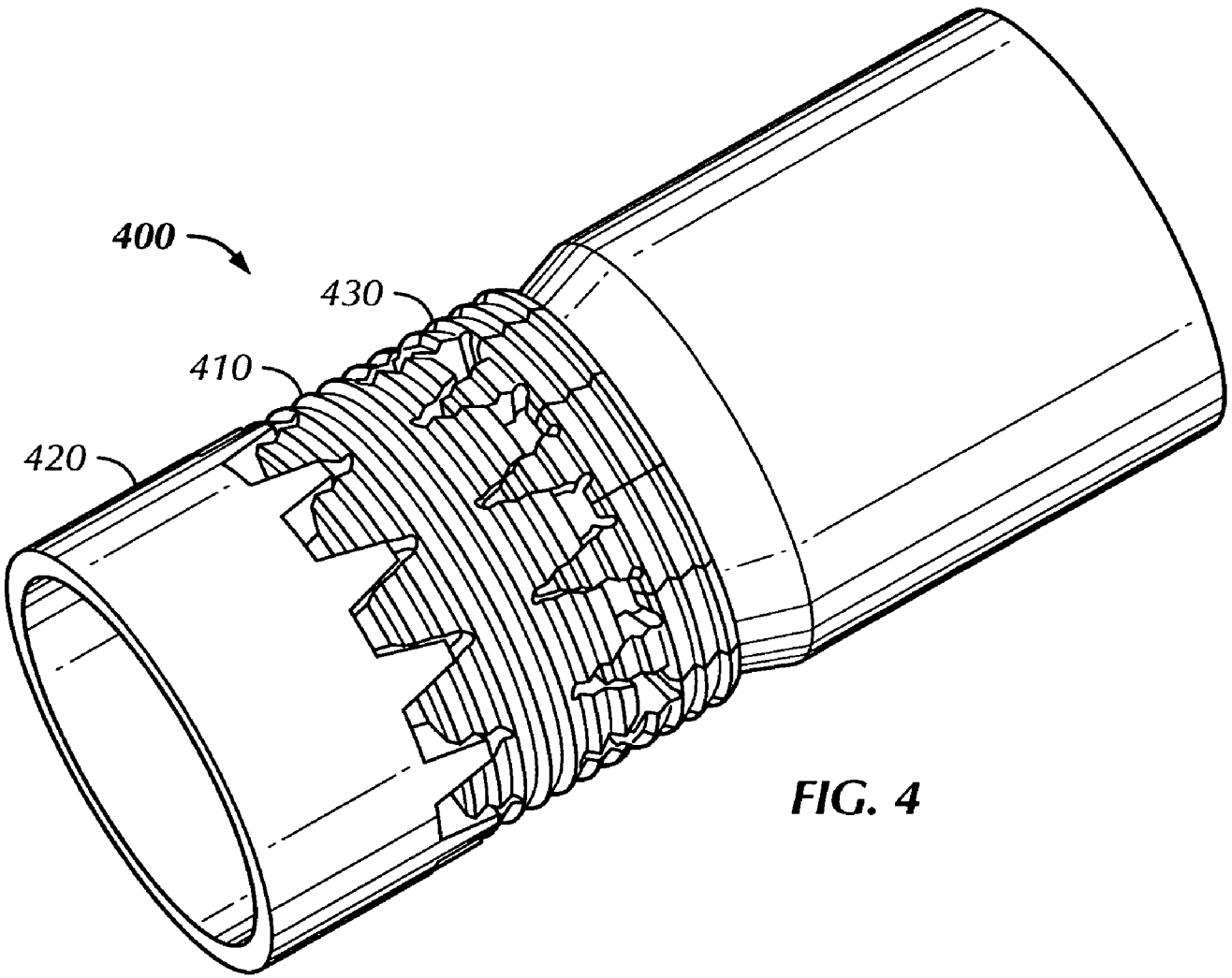
FIG. 4 shows an assembly view of an anchoring device in an unexpanded condition in accordance with embodiments of the present disclosure.

FIG. 4 shows an assembly view of an anchoring device 400 of a packer in an unexpanded condition in accordance with an embodiment of the present disclosure. The unexpanded condition is defined as the state in which the packer is run downhole and before a force is applied to radially expand anchoring device 400 into engagement with the casing wall, or when anchoring device 400 is set. Anchoring device 400 may be disposed at a first end and/or a second end of the packer. Anchoring device 400 includes a frangible ring 410, an expansion ring 420, and a segmented ring 430. Segmented ring 430 includes a plurality of arcuate segments disposed adjacent one another, or side by side, thereby forming a ring. Expansion ring 420 and segmented ring 430 are configured to engage frangible ring 410 on opposite ends.

Figure 4A:
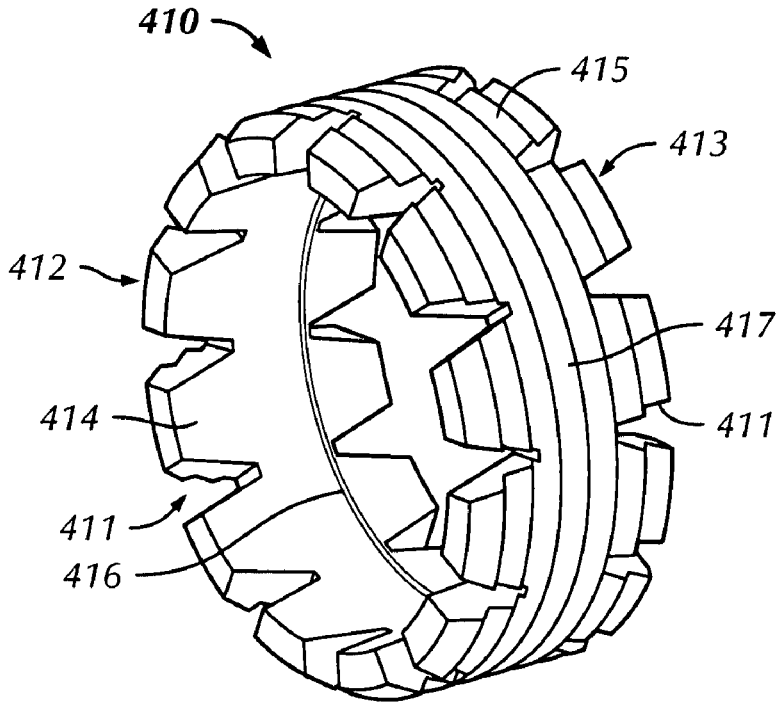
FIG. 4A shows a component view of a frangible ring in accordance with embodiments of the present disclosure.

FIG. 4A shows a component view of frangible ring 410 in further detail in accordance with an embodiment of the present disclosure. Frangible ring 410 includes slots 411 circumferentially disposed on both a first end 412 and a second end 413. Slots 411 may be configured as triangular, square, or other appropriate geometry known to one of ordinary skill in the art. Frangible ring 410 is configured to fracture and separate into individual slip segments 414. The geometry of individual slip segments 414 corresponds to the geometry of slots 411. For example, slots 411 may be triangular and slip segments 414 may be substantially triangular or trapezoidal on both first end 412 and second end 413. The triangular or trapezoidal configuration of slip segments 414 engages triangular slots 411 of segmented ring 430. Frangible ring 410 further comprises grips 415 disposed on an outer circumference for engaging a casing wall. Grips 415 may be configured as teeth or any other devices for gripping a casing wall known to one of ordinary skill in the art. Furthermore, frangible ring 410 may include a shoulder 416 on an inner circumference of frangible ring 410 configured to contact segmented ring 430 (FIG. 4).

Figure 4B:
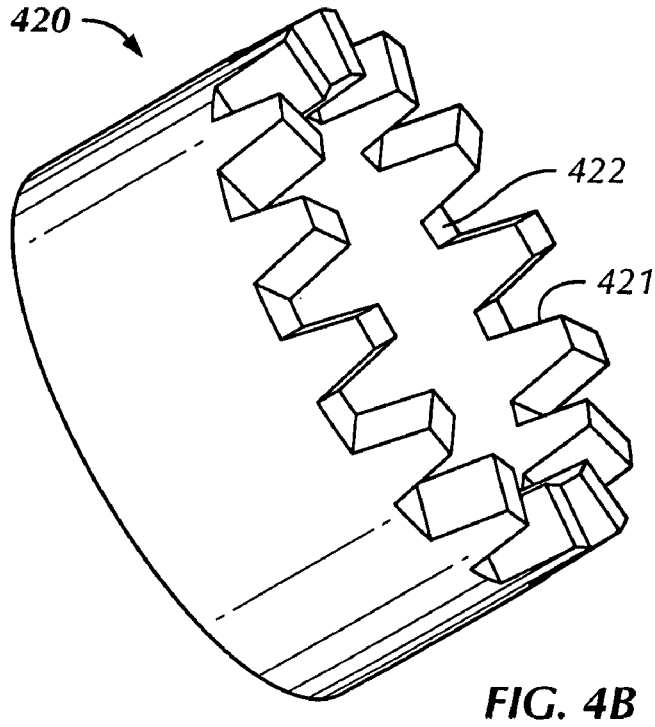
FIG. 4B shows a component view of an expansion ring in accordance with embodiments of the present disclosure.

Referring now to FIG. 4B, a component view of expansion ring 420 is shown in further detail in accordance with an embodiment of the present disclosure. As shown, expansion ring 420 includes a plurality of castellations 421 arranged around a circumference of a first end 422. Castellations 421 are configured as a tongue and groove type shape to engage slots 411 of first end 412 of frangible ring 410 (FIG. 4A). Furthermore, castellations 421 act to wedge into slots 411 of frangible ring 410 when axial force is applied to anchoring device 400 and to split frangible ring 410 into individual slip segments 414 (FIG. 4A). In one embodiment, a second expansion ring may engage slots 411 of second end 413 of frangible ring 410 (FIG. 4A).

Figure 4C:
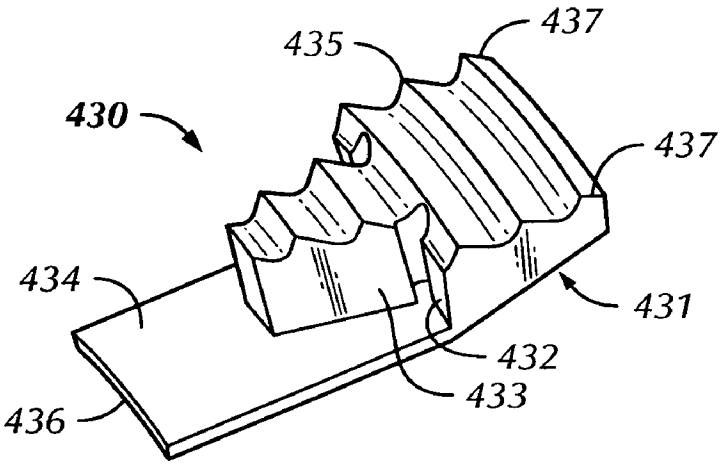
FIG. 4C shows an individual segment from a segmented ring in accordance with embodiments of the present disclosure.

Now referring to FIGS. 4 and 4C, a component view of segmented ring 430 is shown in further detail in accordance with an embodiment of the present disclosure. An arcuate segment 431, which along with a plurality of identical segments 431 form segmented ring 430, is shown for further clarification. In anchoring device 400, segmented ring 430 is configured to engage second end 413 of frangible ring 410. Segment 431 comprises a face 432 which may contact second end 413 of frangible ring 410 and a protrusion 433 configured to engage slot 411 of second end 413 of frangible ring 410. Protrusion 433 may be triangular to engage triangular slot 411 (FIG. 4A). Segment 431 further includes a lip 434 that mates with an inner diameter of frangible ring 410, and of which an end 436 may contact shoulder 416 of frangible ring 410. In an unexpanded condition of anchoring device 400, shoulder 432 and second end 413 of frangible ring 410 are initially at a slight distance apart and are not in contact. Further, protrusion 433 is engaged in slot 411 of second end 413 and lip 434 is in contact with inner diameter of frangible ring 410. Upon axial compression and radial expansion of anchoring device 400 during setting, protrusion 433 may fully engage slot 411 and face 432 may move to contact second end 413 of frangible ring 410. Simultaneously, lip 434 moves axially and end 436 may make contact with lip 416 of frangible ring 410 (FIG. 4A) thereby forming a common inner diameter in anchoring device 400. This engagement further serves to create a more stable connection between components of anchoring device 400 in an expanded condition. Furthermore, segmented ring 430 includes grips 435 on an outer surface for engaging a casing wall. Grips 435 may be configured as teeth or any other gripping device known to one of ordinary skill in the art.

Figure 4D:
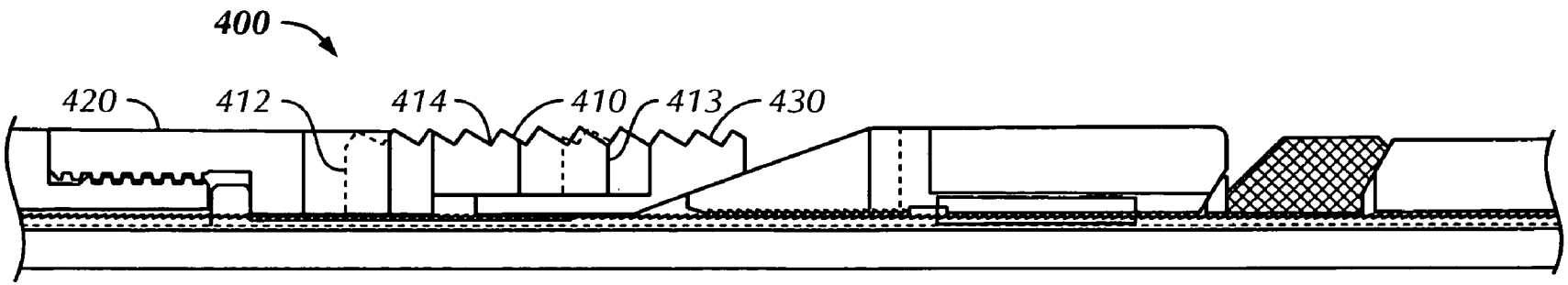
FIG. 4D shows a section view of an anchoring device in an unexpanded condition in accordance with embodiments of the present disclosure.

FIG. 4D shows a section view of anchoring device 400 in accordance with an embodiment of the present disclosure. Anchoring device 400 is shown in an unexpanded condition similar to FIG. 4. As shown, expansion ring 420 engages first end 412 of frangible ring 410, and segmented ring 430 engages second end 413 of frangible ring 410. Frangible ring 410 and expansion ring 420 are initially in contact, but not yet fully engaged, to provide a travel distance between castellations 421 of expansion ring 420 and slots 411 of frangible ring 410 sufficient to split frangible ring 410 into individual slip segments (not individually illustrated).

Figure 5:
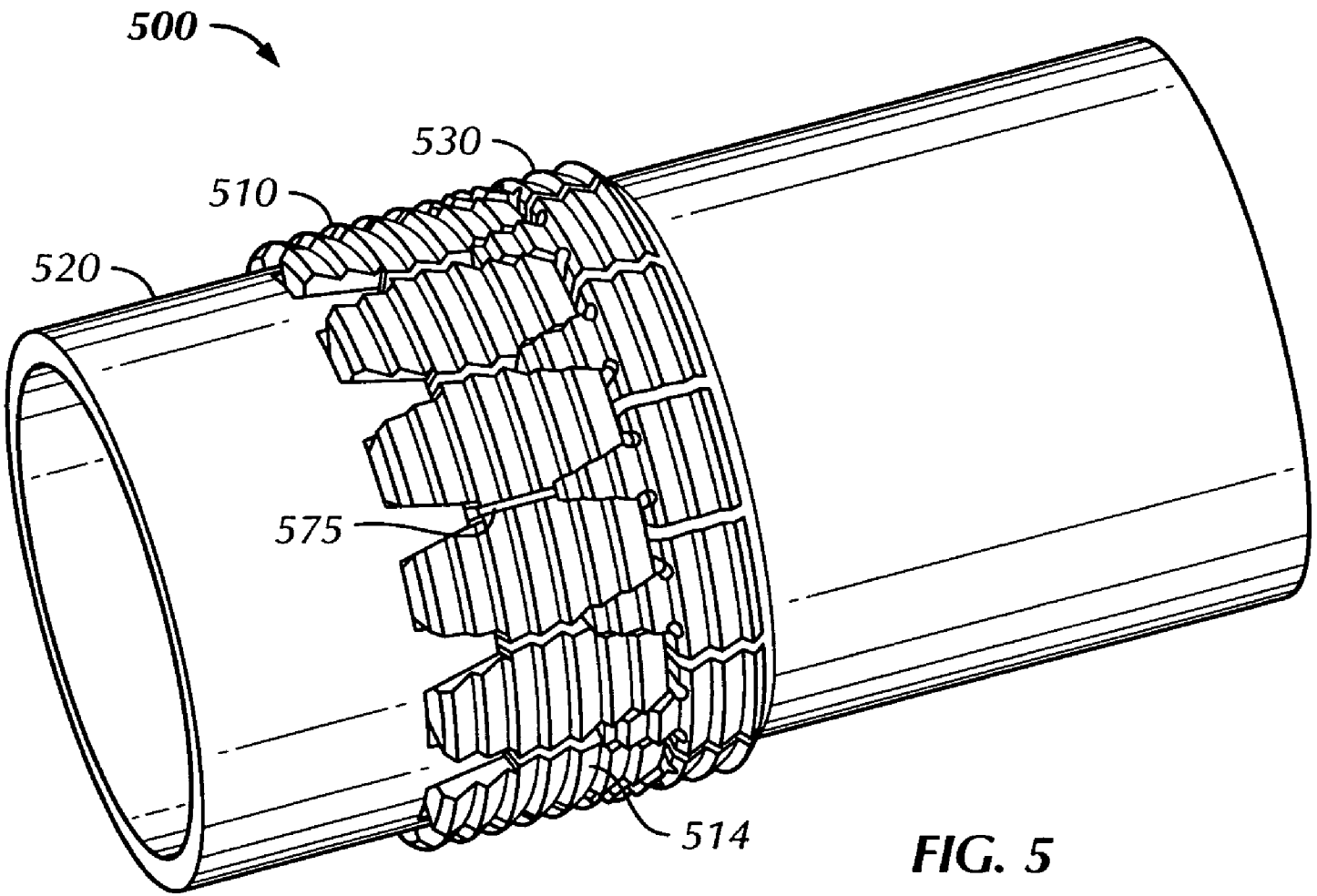
FIG. 5 shows an assembly view of an anchoring device in an expanded condition in accordance with embodiments of the present disclosure.

An assembly view of an anchoring device 500 in an expanded condition is shown in FIG. 5 in accordance with an embodiment of the present disclosure. The expanded condition is defined as the state at which a force has been applied to axially move and radially expand the anchoring device to engage the casing wall and set the anchoring device 500 in the wellbore. As shown, anchoring device 500 includes a frangible ring 510 which has been split into individual slip segments 514, an expansion ring 520, and a segmented ring 530.

Figure 5A:
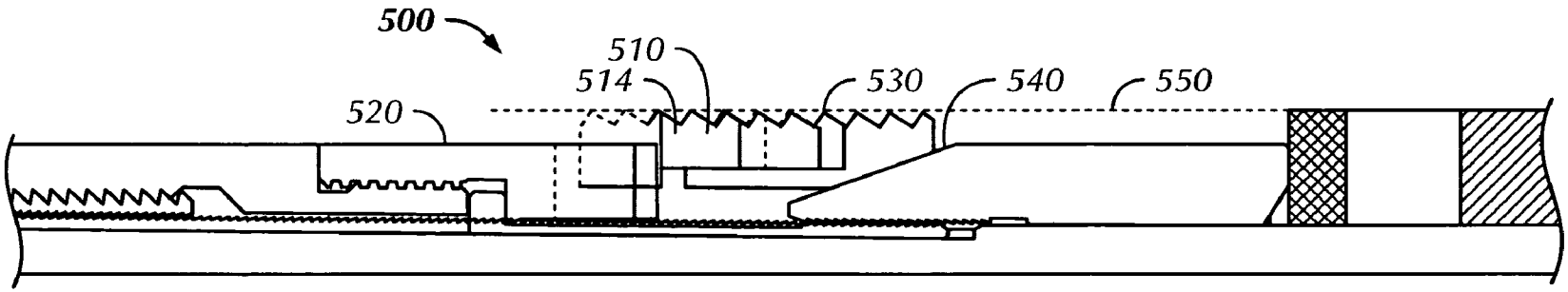
FIG. 5A shows a section view of an anchoring device in an expanded condition in accordance with embodiments of the present disclosure.

Now referring to FIG. 5A, a section view of anchoring device 500 in an expanded condition is shown in accordance with an embodiment of the present disclosure similar to FIG. 5. When setting anchoring device 500 in a wellbore, axial forces are applied to expansion ring 520 which are further transferred to frangible ring 510. Initially, castellations (shown in FIG. 4B) of expansion ring 520 engage slots (shown in FIG. 4A) of frangible ring 510, and segmented ring 530 engages an opposite end of frangible ring 510, as well as an inclined surface 540 as shown. Axial force is then applied to expansion ring 520, causing a compressive force to be applied to both ends of frangible ring 510 by expansion ring 520 on the first end and segmented ring 530 on the second end. This compressive force causes frangible ring 510 to split at weakened points into individual slip segments 514. As anchoring device 500 is set, segmented ring 530 expands radially outward, traveling on inclined surface 540 before engaging casing wall 550. Further, slip segments 514 of frangible ring 510 travel in a radially outward and axial direction simultaneously until making contact with casing wall 550. Slip segments 514 travel both radially outward and axially because of the interaction between the triangular or trapezoidal configuration of the ends of slip segments 514 (FIG. 4A) and the triangular slots of frangible ring 510. Axial movement of expansion ring 520, as well as axial and radial movement of slip segments 514 and segmented ring 530 continue until anchoring device 500 is set in casing 550.

Figure 6:
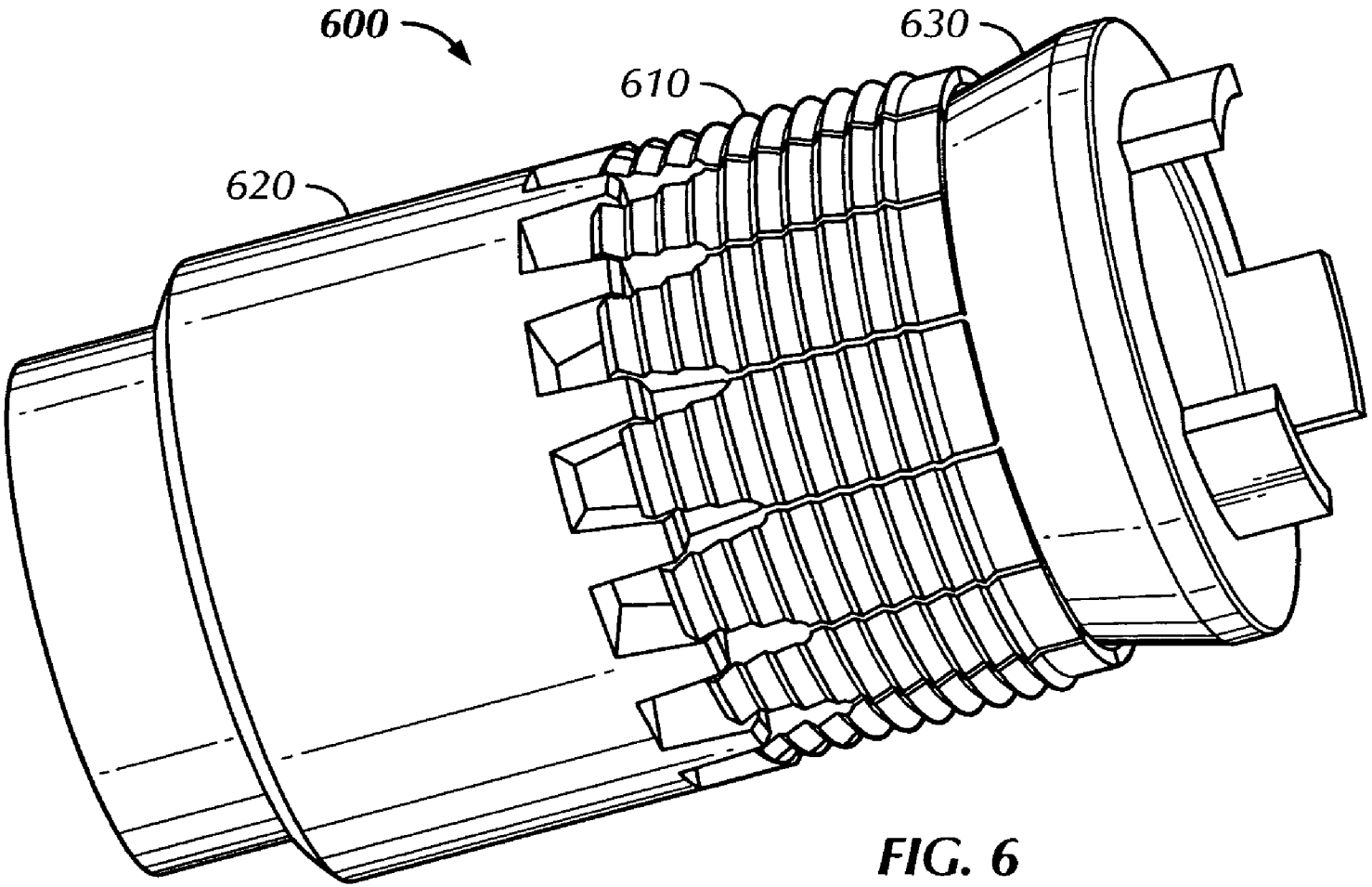
FIG. 6 shows an assembly view of an anchoring device in an unexpanded condition in accordance with embodiments of the present disclosure.

Referring to FIG. 6, an assembly view of an anchoring device 600 is shown in accordance with an embodiment of the present disclosure. In the embodiment shown, anchoring device 600 includes a frangible ring 610, an expansion ring 620, and a cone 630. Expansion ring 620 and cone 630 are configured to engage frangible ring 610 on opposite ends. In one embodiment, frangible ring 610 may be formed of cast iron. In alternate embodiments, frangible ring 610 may be formed of a composite material, including aluminum and cast iron.

Figure 6A:
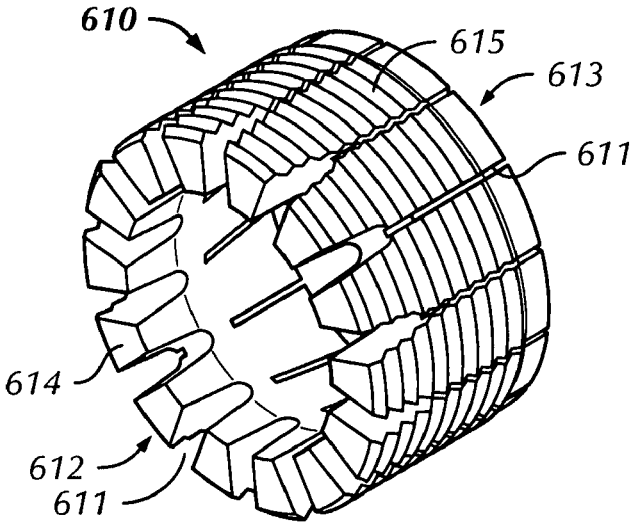
FIG. 6A shows a component view of a frangible ring in accordance with embodiments of the present disclosure.

Referring to FIG. 6A, a component view of frangible ring 610 is shown in further detail in accordance with an embodiment of the present disclosure. Frangible ring 610 includes slots 611 circumferentially disposed on a first end 612 and a second end 613. Slots 611 may be configured as triangular, square, groove or other appropriate geometry known to one of ordinary skill in the art. Frangible ring 610 is configured to fracture and separate into individual slip segments 614 in an expanded condition. Frangible ring 610 includes grips 615 disposed on an outer circumference for engaging a casing wall. Grips 615 may be configured as teeth or any other device for gripping a casing wall known to one of ordinary skill in the art.

Figure 6B:
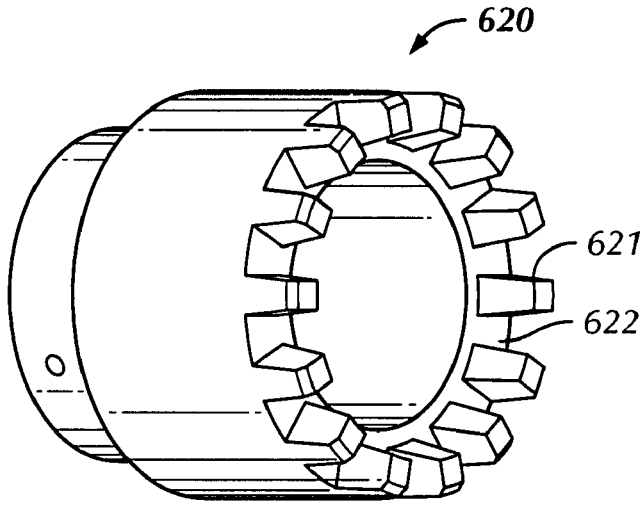
FIG. 6B shows a component view of an expansion ring in accordance with embodiments of the present disclosure.

Now referring to FIG. 6B, a component view of expansion ring 620 is shown in further detail in accordance with an embodiment of the present disclosure. As shown, expansion ring 620 includes a plurality of castellations 621 arranged around a circumference of a first end 622. Castellations 621 are configured as a tongue and groove type shape to engage slots 611 of first end 612 of frangible ring 610 (FIG. 6A). Furthermore, castellations 621 act to wedge into slots 611 of frangible ring 610 when axial force is applied to anchoring device 600 and to split frangible ring 610 into individual segmented slips 614. In one embodiment, a second expansion ring may engage slots 611 of second end 613 of frangible ring 610 (FIG. 6A).

Figure 6C:
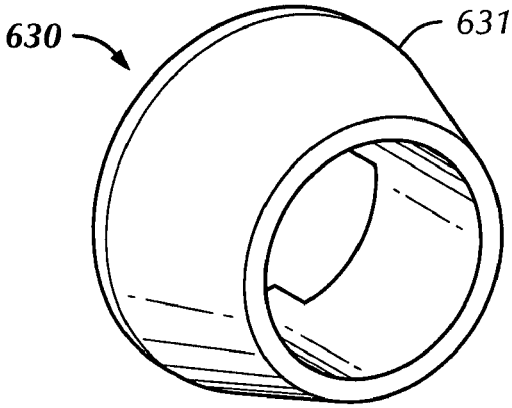
FIG. 6C shows a component view of a cone in accordance with embodiments of the present disclosure.

FIG. 6C shows a component view of cone 630 in further detail in accordance with an embodiment of the present disclosure. Cone 630 has a tapered outer surface 631 configured to engage an inner surface of second end 613 of frangible ring 610. During the process of expanding the anchoring device 600, slip segments 614 are configured to travel axially and radially outward on outer surface 631 and come into engagement with a casing wall (not shown).

Figure 6D:
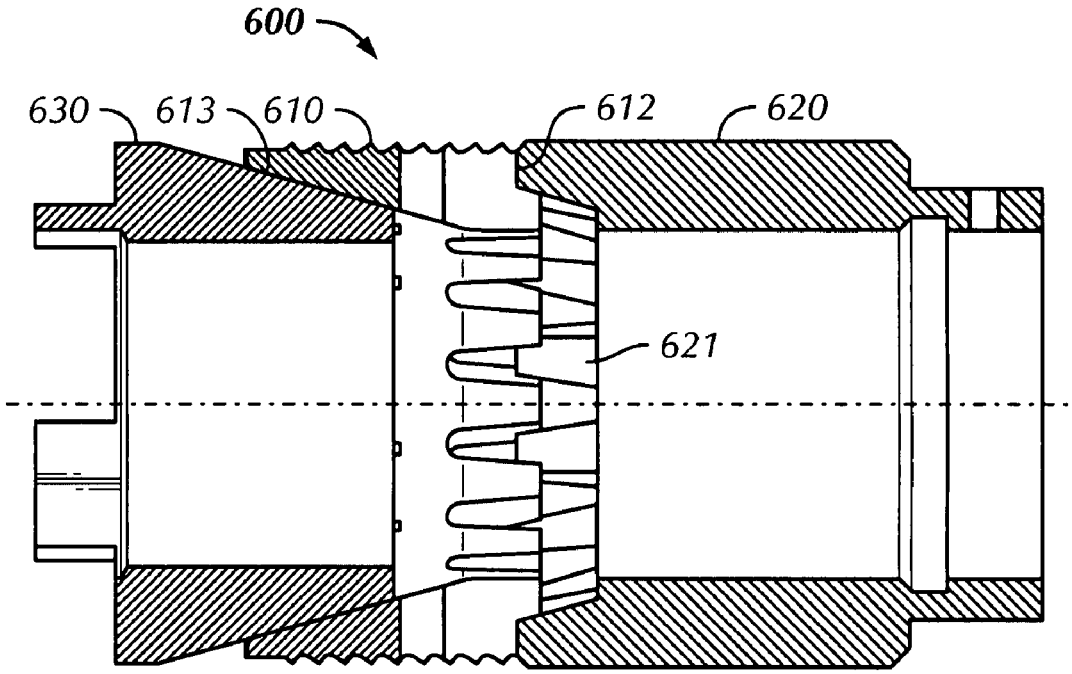
FIG. 6D shows a section view of an anchoring device in an unexpanded condition in accordance with embodiments of the present disclosure.

Referring now to FIG. 6D, a section view of anchoring device 600 is shown in accordance with an embodiment of the present disclosure. Anchoring device 600 is shown in an unexpanded condition similar to FIG. 6. As shown, expansion ring 620 engages first end 612 of frangible ring 610, and cone 630 engages an inner diameter of second end 613 of frangible ring 610. Frangible ring 610 and expansion ring 620 are initially at a distance away from each other, so as to provide castellations 621 a sufficient travel distance to split frangible ring 610 into a number of individual slip segments.

Figure 7:
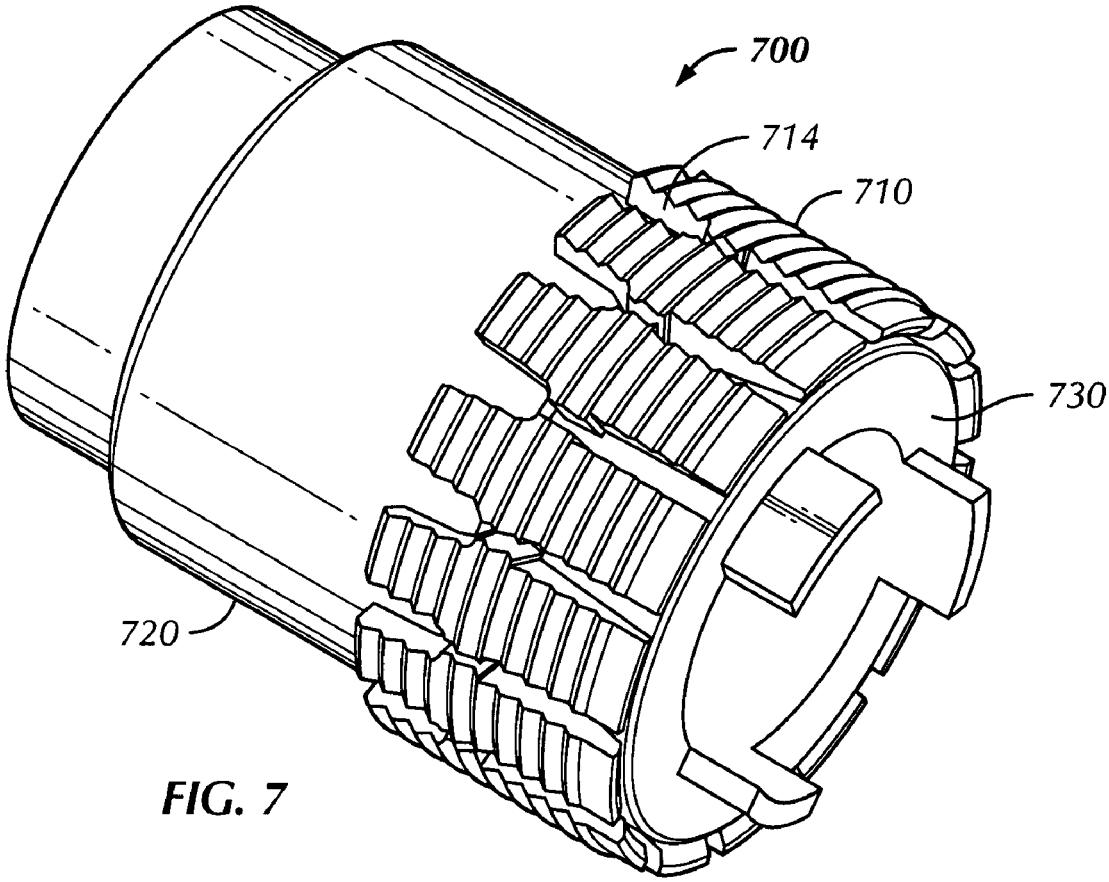
FIG. 7 shows an assembly view of an anchoring device in an expanded condition in accordance with embodiments of the present disclosure.

FIG. 7 shows an assembly view of anchoring device 700 in an expanded condition in accordance with an embodiment of the present disclosure. The expanded condition is defined as the state at which a force has been applied to radially expand and engage the casing wall and set the anchoring device 700 in the wellbore. Anchoring device 700 includes a frangible ring 710, shown split into individual slip segments 714, an expansion ring 720, and a cone 730.

Figure 7A:
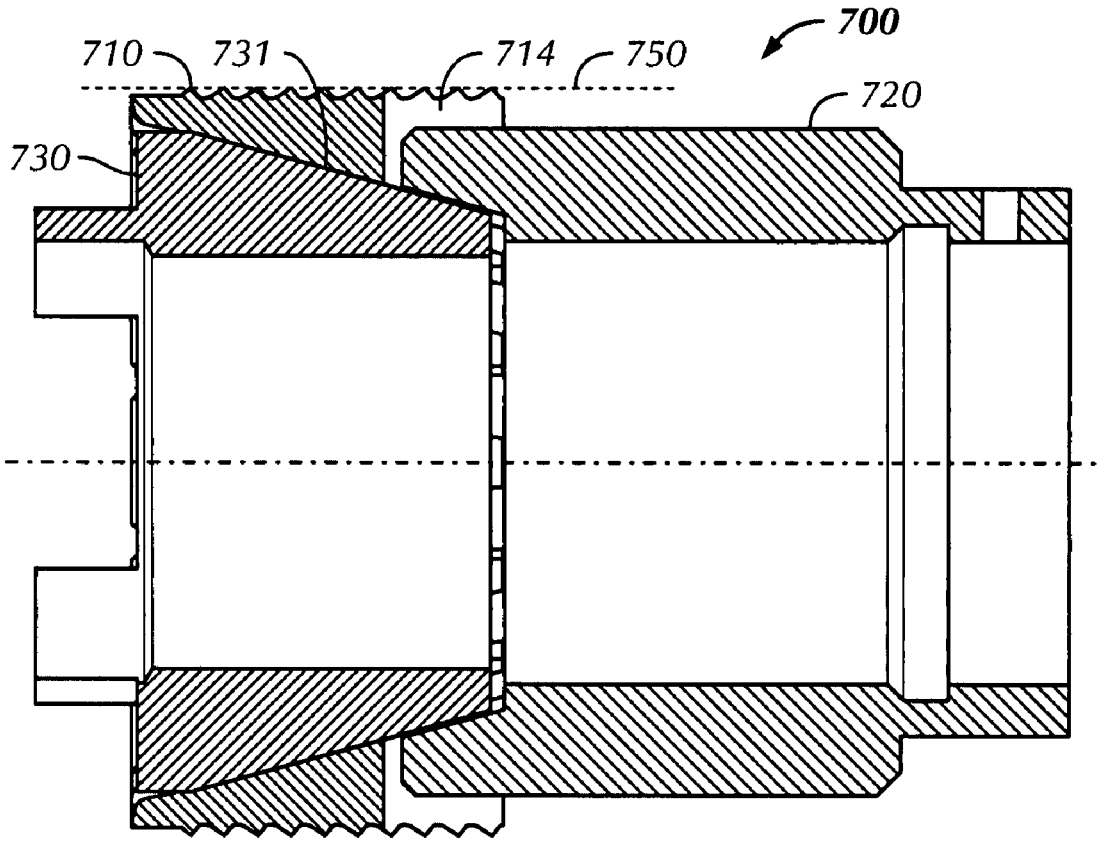
FIG. 7A shows a section view of an anchoring device in an expanded condition in accordance with embodiments of the present disclosure.

Now referring to FIG. 7A, a section view of anchoring device 700 in an expanded condition is shown in accordance with an embodiment of the present disclosure similar to FIG. 7. When anchoring device 700 is set, axial forces are applied to expansion ring 720 and transferred to frangible ring 710. Expansion ring 720 forces frangible ring 710 to split at weakened points into individual slip segments 714. As frangible ring 710 is split into slip segments 714, the axial force from expansion ring 720 forces slip segments 714 to move in an axial direction and engage an outer surface of cone 730. Slip segments 714 of frangible ring 710 travel up outer surface 731 of cone 730 until they engage a casing wall 750. Axial movement of expansion ring 720, and axial and radial movement of slip segments 714 continue until fully engaged with casing wall 750 and anchoring device 700 is set in the wellbore.

Embodiments of the present disclosure offer a number of advantages in the engagement of an anchoring device of a packer in a wellbore. In embodiments disclosed herein, the arcuate segments forming the segmented ring have a larger radius of curvature than the casing in which they are set. More specifically, arcuate segments of the segmented ring have an outer curvature, which forms an "outer diameter" when all the arcuate segments are placed adjacent one another to form the segmented ring. Referring back to FIG. 4C, when the segmented ring 430 is expanded radially, the larger radius of curvatures of the arcuate segments 431 bite into the smaller radius of curvature of the casing at corners 437 resulting in a "corner bite." That is, corners 437 of arcuate segment 431 engage the casing most aggressively, creating high stress zones in the contact area between arcuate segments 431 and the casing. In one embodiment, the radius of curvature of arcuate segments 431 may be ¼ inch greater than the radius of the casing. In other embodiments, the radius of curvature of arcuate segments 431 may be 1 inch greater than the radius of the casing. One of ordinary skill in the art will appreciate that the difference in the radius of curvature between segments of segmented ring 430 and the casing may vary without departing from the scope of embodiments disclosed herein. Further, the radius of curvature of segments of the segmented ring 430 may vary without depending on, for example, the length or diameter of the casing, so long as the radius of curvature of the segments of the segmented ring 430 is greater than the radius of the casing. Proper sizing of the radius of curvature of arcuate segments 431 would be known to one of ordinary skill in the art.

Furthermore, referring back to FIG. 4A, the radius of frangible ring 410 may be smaller than the radius of the casing into which it is set, causing the teeth to engage the pipe on a center line 417 of each slip segment 414, resulting in a "center bite." That is, center line 417 of slip segment 414 engages the casing most aggressively, creating high stress zones in the contact area between slip segments 414 and the casing. The combination of high stress areas created by the corner bite and center bite phenomena may be desirable when alternated over an engagement contact area with the casing.

Figure 8:
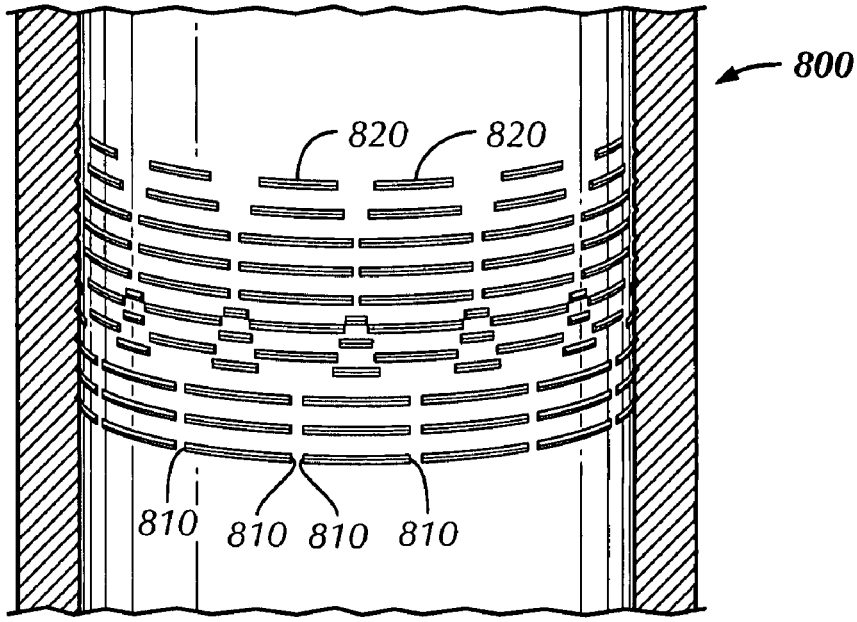
FIG. 8 shows a view of a load distribution in a casing in accordance with embodiments of the present disclosure.

With the alternating corner bite/center bite effect, the three adjacent pieces (arcuate segment-slip segment-arcuate segment) provide five contact points between the anchoring device and the casing wall, as opposed to the three contacts points provided by previous anchor mechanisms (all center bites). The alternating corner bite/center bite effect results in a more uniform radial load distribution in the casing. Because the loads are no longer concentrated at the centerline of each segment, a complete full circle foot print is created that distributes the contact stresses over the entire contact area between the engaged slip segments, segmented ring, and the casing. FIG. 8 shows grip indentations on the inside wall of a casing formed by a frangible ring and segmented ring according to embodiments of the present disclosure. The indentations of FIG. 8 represent a uniform load distribution 800. As shown, the combination of corner bites 810 and center bites 820 of segmented ring and frangible ring, respectively, provides a more even distribution of stresses along the inner circumference of casing wall.

In another embodiment, the segmented ring may be configured with a plurality of segments having substantially planar surfaces on inner and/or outer circumferences. The plurality of substantially planar surfaces form a segmented "ring" having a polygonal configuration on the inner and outer circumferences. Anchor assemblies in accordance with this embodiment may present machining and/or assembly limitations due to the planar surfaces. Configured as such, the segmented ring may perform the function of providing corner bites in the casing and help create a more uniform load distribution.

Figure 9:
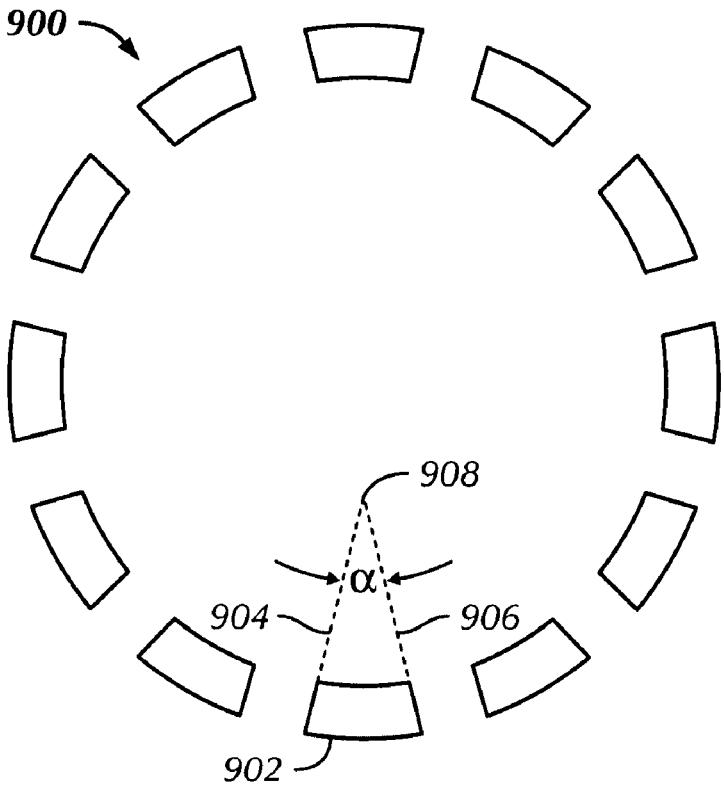
FIG. 9 shows a cross-sectional view of a frangible ring in accordance with embodiments of the present disclosure.

In embodiments disclosed herein, the frangible ring is split into individual slip segments having a wedge-shaped cross-sectional area as viewed from at least one end of the frangible ring. FIG. 9 is a representative footprint of a frangible ring 900 as viewed from one end. As is shown, each slip segment 902 has a wedge-shape cross-section. If a plane of a first side 904 and a plane of a second side 906 are extended inward until they intersect 908, a "radial wedge angle" $\alpha$ is created. Angle $\alpha$ may vary dependent upon the number of slip segments 902 that comprise frangible ring 900, as well as the outer circumference measurement required of frangible ring 900. For example, frangible ring 900 may be comprised of 12 slip segments, each having a cross-section wedge angle of about 30 degrees. Further, frangible ring may be comprised of 10 slip segments, each having a cross-section wedge angle of 36 degrees. One of ordinary skill in the art will appreciate the configuration of a wedge-shape cross-section and the ability to vary the radial wedge angle.

The wedge-shape cross section provides an advantage to the radial engagement between the slip segments of the frangible ring and the casing wall. In the expansion of the anchoring device, the castellations of the expansion ring force the slip segments to move in an axial direction toward the segmented ring. The wedge-shape cross-section of the slip segments forces the slip segments to travel in both an axial and radial direction simultaneously, ensuring a positive engagement between the anchoring device and the casing wall. The ability to vary the radial wedge angle of the slip segments may become an important factor as the diameter of the casing in which the packer is set increases. As mentioned previously, varying the radial wedge angle of the slip segments is related to the number of slip segments forming the frangible ring which correlates to the number of slots cut into ends of the frangible ring. For example, increasing the number of slots cut in each end of the frangible ring provides a larger or steeper radial wedge angle of the slip segments.

Another advantage presented by embodiments of the present disclosure is the self locking feature of the anchoring device provided by the tongue and groove connection between the expansion ring and the frangible ring. The wedge shaped castellations are in full contact with the slots of the frangible ring and create a stable "full circle" mechanism that is self locking. Furthermore, the tongue and groove geometry helps "distribute" the space created when the frangible ring breaks into small uniform spaces adjacent to each segment instead of allowing a large gap to form on one side of the casing wall. This arranges the expanded slips evenly around the inner circumference of the casing wall rather than having random spaces scattered around the circumference of the casing.

Furthermore, the self-locking fall circle engagement formed between the segmented ring and frangible ring may help to prevent the extrusion of the sealing element (FIGS. 2 and 3). As mentioned, the sealing element is formed of material such as elastomer or rubber, and therefore may be capable of extruding through cracks in the anchor mechanism. The sealing element interfering with the anchor mechanism may be detrimental to the packer set in the casing as well as the integrity of the seal. Referring now to FIG. 5, to prevent or reduce extrusion of the sealing element, the lip 434 of the arcuate segments 431 (FIG. 4C) forming the segmented ring 530 advantageously obstructs or closes extrusion spaces 575 created between slip segments 514 when frangible ring 510 is split. Further, the triangle-shaped protrusions of the arcuate segments of the segmented ring are in full contact with the slots of the frangible ring. This engagement creates a stable full circle mechanism preventing the extrusion of the sealing element through radial cracks. Furthermore, the addition of a backup element, which would be known to one of ordinary skill in the art, may be used in conjunction with the aforementioned configuration to prevent extrusion of the sealing element.

While the invention has been described with respect to a limited number of embodiments, those skilled in the art, having benefit of this disclosure, will appreciate that other embodiments may be devised which do not depart from the scope of the invention as disclosed herein. Accordingly, the scope of the invention should be limited only by the attached claims.

What is claimed:

1. An anchoring device to secure a packer assembly within a casing, comprising:

a frangible ring having a plurality of grips on an outer circumference, wherein a first end and a second end of the frangible ring comprise a plurality of circumferentially spaced slots;

an expansion ring having a plurality of castellations configured to engage the slots of the first end of the frangible ring; and a segmented ring comprising a plurality of segments configured to engage the slots of the second end of the frangible ring;

wherein a curved outer surface of each of the individual arcuate segments of the segmented ring has a radius of curvature that is larger than the radius of curvature of an inner diameter of the casing.

2. The anchoring device of claim 1, wherein the frangible ring comprises a plurality of slip segments having a cross-sectional wedge shape.

3. The anchoring device of claim 2, wherein the cross-sectional wedge shape of the slip segments provides an axial force and radial force simultaneously.

4. The anchoring device of claim 2, wherein a radius of curvature of each of the plurality of slip segments of the frangible ring is less than the radius of the casing.

5. The anchoring device of claim 1, wherein the segmented ring and the frangible ring radially engage the casing in an alternating corner bite/center bite configuration, respectively, providing a uniform load distribution on the casing.

6. The anchoring device of claim 1, wherein slots on first and second end of frangible ring are triangular.

7. The anchoring device of claim 1, further comprising a full circle engagement between the frangible ring and the segmented ring, thereby preventing extrusion of a sealing element through radial cracks.

8. The anchoring device of claim 1, wherein the segmented ring is formed by individual arcuate segments having a curved outer surface.

9. The anchoring device of claim 1, wherein the segmented ring is formed by individual segments having substantially planar outer surfaces.

10. The anchoring device of claim 1, further comprising a second expansion ring configured to engage the slots of the second end of the frangible ring.

11. The anchoring device of claim 1, further comprising a cone configured to engage an inside surface of a second end of the frangible ring.

12. The anchoring device of claim 1, wherein the castellations of the expansion ring are configured as a wedge to split the frangible ring into individual slip segments.

13. The anchoring device of claim 1, wherein the engagement of the expansion ring and the first end of the frangible ring provides an axial force.

14. The anchoring device of claim 1, wherein a tongue and groove configuration engages the expansion ring and the segmented ring with the frangible ring, providing a uniform radial load distribution on the casing when in an expanded condition.

15. A method to secure a packer assembly in a casing, comprising:

engaging a plurality of arcuate segments of a segmented ring with a plurality of slots in a first end of a frangible ring;

engaging a plurality of castellations of an expansion ring with the plurality of slots on a second end of the frangible ring; and moving the expansion ring in an axial direction towards the frangible ring and splitting the frangible ring into a plurality of slip segments, thereby radially extending the plurality of slip segments and segmented ring into the casing;

engaging the arcuate segments having a radius of curvature larger than a radius of curvature of the casing with the frangible ring, thereby providing a uniform load distribution in the casing.

16. The method of claim 15, further comprising engaging segmented ring with the slots of the frangible ring, thereby providing a full circle engagement to prevent the extrusion of a sealing element through radial cracks.

17. The method of claim 15, wherein slip segments having a cross-sectional wedge shape engage arcuate segments and move in a radial and an axial direction simultaneously to engage casing.

18. The method of claim 15, wherein arcuate segments and frangible ring engage the casing in a corner bite/center bite configuration, thereby providing a uniform load distribution in casing.

* * * * *